United States Patent [19]

Nopanen

[11] 4,088,869

[45] May 9, 1978

[54] TEMPERATURE LIMITING CIRCUIT FOR ELECTRIC HAIR DRYERS

[75] Inventor: Esko J. Nopanen, Asheboro, N.C.

[73] Assignee: General Electric Company, Bridgeport, Conn.

[21] Appl. No.: 610,977

[22] Filed: Sep. 8, 1975

Related U.S. Application Data

[63] Continuation-in-part of Ser. No. 572,454, Apr. 28, 1975, abandoned.

[51] Int. Cl.[2] ..... H05B 1/02; F24H 3/04

[52] U.S. Cl. ..... 219/364; 34/97; 219/363; 219/370; 219/376; 219/484

[58] Field of Search ..... 219/363, 364, 380–382, 219/366–376, 501, 484; 34/96–101, 243 R

[56] References Cited

U.S. PATENT DOCUMENTS

| | | | |
|---|---|---|---|
| 1,978,413 | 10/1934 | Child | 219/370 X |
| 2,080,799 | 5/1937 | Wiegand | 219/364 X |
| 3,089,942 | 5/1963 | Wrigglesworth et al. | 219/364 X |
| 3,308,268 | 3/1967 | Laing | 219/366 X |
| 3,731,057 | 5/1973 | Kunz et al. | 219/364 X |

FOREIGN PATENT DOCUMENTS

| | | | |
|---|---|---|---|
| 523,717 | 4/1931 | Germany | 219/380 |
| 662,887 | 7/1938 | Germany | 219/381 |

*Primary Examiner*—A. Bartis

*Attorney, Agent, or Firm*—John F. Cullen; George R. Powers; Leonard J. Platt

[57] ABSTRACT

A hair dryer includes a casing having an air inlet and an air exit defining an exit plane. A motor driven fan propels air through the casing between the air inlet and exit. Plural wattage electric heating elements are disposed in a heater box in the casing for heating air to a selected temperature for discharge through the casing air exit. A thermostat, positioned downstream of the heating elements substantially centrally across the exit plane of the casing and disposed substantially in the exit plane, is connected in series circuit with at least some of the heating elements. The thermostat rapidly senses the air temperature at the air exit and disconnects the connected heating elements.

3 Claims, 4 Drawing Figures

TEMPERATURE LIMITING CIRCUIT FOR ELECTRIC HAIR DRYERS

BACKGROUND OF THE INVENTION

This application is a continuation-in-part application of my application Ser. No. 572,454, filed Apr. 28, 1975 now abandoned.

FIELD OF THE INVENTION

This invention relates to a hair dryer of the type having a heater box with plural wattage heaters and is directed to the specific placement of a single thermostat or an extra thermostat with respect to the heaters to provide for more accurate and rapid sensing of the exit air temperature to detect overtemperature conditions.

DESCRIPTION OF THE PRIOR ART

Various types of hand-held dryers of differing wattages have come into vogue. These are generally classified as pistol-type dryers, purse-type dryers, or styling dryers. The prime difference is in the general overall shape since all are used for drying and styling the hair. Generally, the dryers consist of a blower and heater assembly to direct the hot air stream over the hair as it is combed or brushed and the dryers may have various attachments such as combs, brushes, or concentrators or the like, to style the hair as the air is directed on or through it. Generally, the dryers include motor-driven fans of the cross flow, centrifugal, or tangential variety, a usually rectangular heater box downstream of the fan and which mounts plural wattage heaters of coiled resistance wires across the heater box. Conventionally, a thermostat means is disposed in one of the side walls of the heater box always upstream of its exit in order to sense temperature rise of the air through the heater box or the heater box itself due to varying causes such as fan blockage, exit air blockage, or heat rises caused by frictional obstructions of one sort or another. In the event of an overtemperature condition, the thermostat disconnects the heaters when it senses the abnormal condition and this may permit the fan to continue running if the fan motor is a 110 volt system or, more commonly, the whole system is completely shut down when cheaper low voltage DC motors are used. In either case, the heater circuit is opened. In the latter DC case it is common to obtain the correct motor voltage by connecting resistance in series with the motor, consisting of low wattage heaters in the heater box. Thus, these heaters serve the dual purposes of reducers for voltage control and a source of low wattage heat—the more common way of reducing cost in common styling dryers. By using plural or several differing resistance wires, various wattages are obtained all as well known. In the continual wattage race in hair dryers, the air is heated faster and to higher temperatures with concomitant problems in the event of overheating. The customary arrangement of providing thermostatic means by attaching a thermostat to the side of the heater box does not always permit sufficiently rapid sensing of temperature with a resultant correction (shut down) in time to prevent damage. For example, in 1000 wats dryers, a blockage at the dryer air exit can result in a very rapid temperature rise which must be sensed immediately (within a few seconds) and corrected if damage is to be prevented. Thus, an improved temperature sensing and rapid responding arrangement is required in today's high wattage dryers.

SUMMARY OF THE INVENTION

Briefly described, the invention is directed to a hair dryer of the type having a motor-driven fan, a heater box with plural wattage heaters connected in the box and disposed at the fan exit for heating the air to various selected temperatures after it leaves the fan. Thermostat means senses the air temperature and initiates corrective action on an overtemperature condition. In this known setting the invention provides an improvement comprising thermostat means disposed directly in the exit plane of the heater box and downstream of all the plural wattage heaters and disposed substantially entirely in the exit air stream to respond primarily to exit air temperature only. This thermostat is connected in series with at least some of the heaters. The invention is applicable either to 110 volt AC fan motors or to the more common low voltage DC motor that uses at least some heaters in series with the motor circuit to both reduce the voltage to the motor and to provide the low wattage heat to the air. Thus, the main object is to provide an improved temperature sensing arrangement that responds rapidly to abnormal conditions and takes immediate corrective action.

DESCRIPTION OF THE PREFERRED EMBODIMENT

Figure 1:
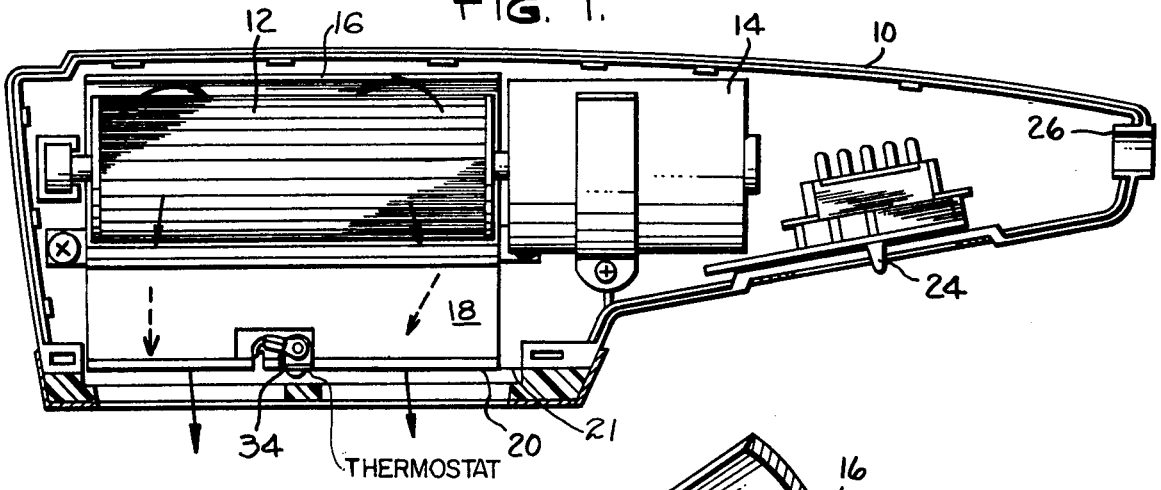
FIG. 1 is a cross section of a typical styling dryer showing the conventional arrangement of parts.
Figure 2:
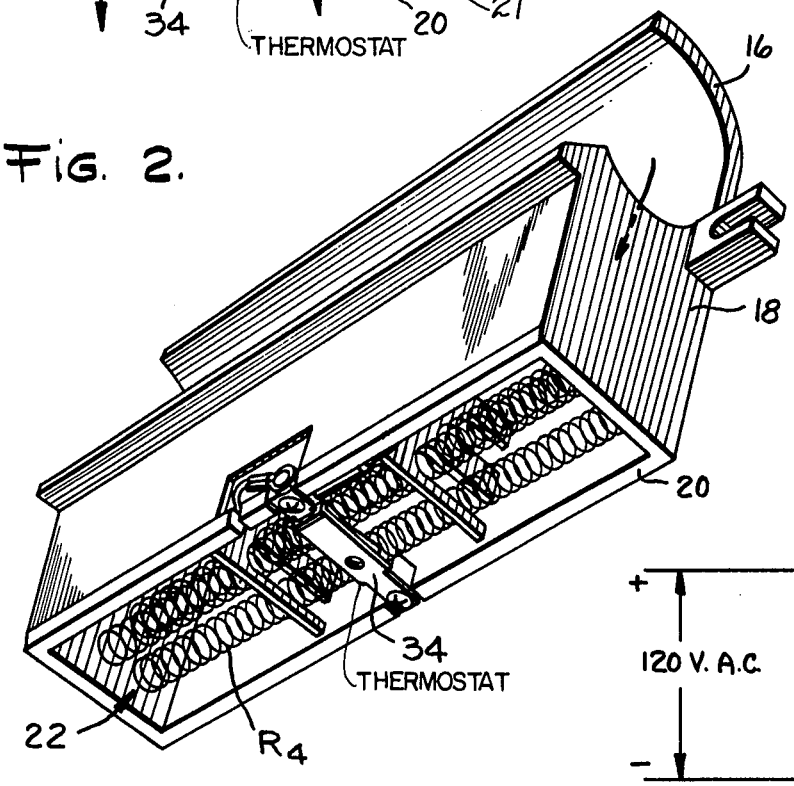
FIG. 2 is a perspective of the heater box assembly showing the invention applied.

While the invention is applicable to any general style of hand-held hair dryer, it will be specifically described in connection with a common styling dryer that employs a low voltage DC motor. Referring to FIG. 1, there is shown a typical hand-held hair dryer with a casing 10 having an air inlet (not shown) and an air exit defining a casing exit plane 21 supporting a cross flow fan 12 driven by motor 14. The fan may be suitably supported to rotate in a cup-shaped guide 16 that may be part of an integral molding forming heater box 18 as shown in FIG. 2. The heater box as used in the illustrative form of FIG. 2 is a generally rectangular closed box having four sides to form a guide and air is pumped by fan 12 from outside the casing through the heater box and out heater box exit plane 20 onto the user's hair as shown by the arrow. Conventionally, the heater box, in addition to forming a guide, also serves as a support for one or more and preferably plural wattage heaters, generally indicated at 22, which are differing resistance wires across the box and which are connected in various combinations by switch 24 to also control motor speed to provide low heat-low velocity air, high heat-high velocity air, or plain high velocity air as desired. These provide various well known combinations of styling and drying. Although the invention could be applied to a single wattage heater, the state of the art has long passed such devices because of low capacity and lack of flexibility - thus, plural heaters are preferred for flexibility. Suitable cord means not shown provides power through the handle portion 26 of casing 10.

Most hand-held dryers provide thermostatic control of heater box temperatures by a thermostat mounted in an opening usually in the upper side of the heater box well upstream of the exit plane 20 where it senses temperature inside the box. If, for some reason, the fan does not turn or turn fast enough and push air through the heater box, then thermostat senses the high temperature in the box and shuts power to the heaters to protect the dryer against an overtemperature condition.

Figure 3:
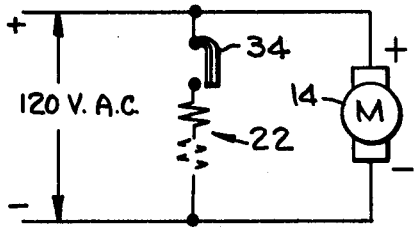
FIG. 3 is a schematic circuit diagram of a 110 volt AC arrangement.

In the two general types of styling dryers, the motor 14 may be a 110 volt AC motor across the line as shown in FIG. 3 in which case the circuit-opening function of the thermostat permits the motor to continue running while cutting the heaters out of the system (the thermostat is shown open) permitting the heaters to cool down and the device to recycle — a desired arrangement. In the low voltage DC motor system shown in FIG. 4 part of the resistances R1 and R2 (the low wattage heaters) are usually connected in series with the fan motor to control the voltage drop to the DC motor 14 which operates through the full wave rectifier bridge 32 while the remaining high wattage heaters R3 and R4 are generally in parallel or non-series connected with the motor.

In both cases, a thermostat upstream of the exit plane 20 of the heater box to limit the heater box temperature would not limit the temperature of the exit air stream. Under conditions of partial air blockage at the inlet/outlet of the dryer or under slowed motor situations, the temperature of the heater box, as sensed by the conventional upstream thermostat, may remain cool relative to the exit air which is heated further by the downstream high wattage heaters. Additionally, the fan pushes enough cool air through the heater box to keep the upstream thermostat from immediately reacting while the air temperature at the outlet of the heater box may rise excessively when the high wattage heaters are on. Further, the thermostat upstream in the wall of the heater box normally reacts relatively slowly since it is also sensing the temperature of the box itself as well as sensing the relatively cooler temperature of the air upstream of the high wattage heaters. In the AC form of FIG. 3, no great damage occurs since motor 14 continues to run but the thermosat reaction time is still relatively slow. In the more common low voltage DC arrangement of FIG. 4 which is the structure shown in FIGS. 1 and 2, the common side mount thermostat shuts down all the heaters as well as the motor circuit. In this DC application the reaction time must be much faster in order to prevent damage by the high wattage heaters R3 and R4.

Figure 4:
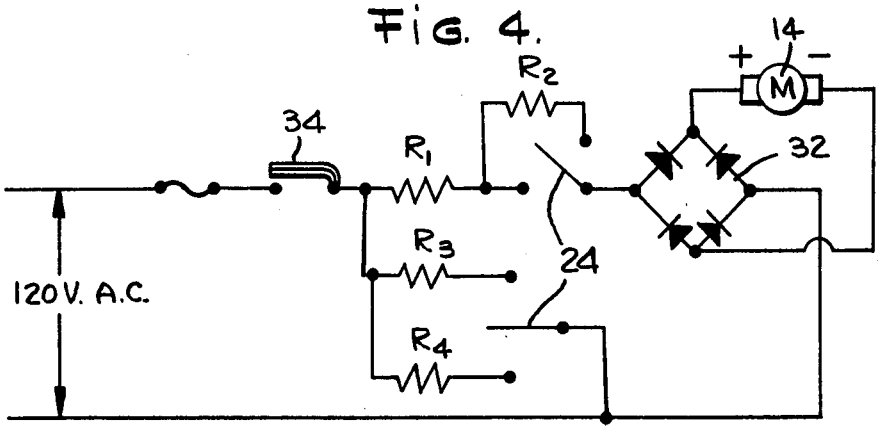
FIG. 4 is a schematic circuit diagram of the invention as applied to a low voltage DC motor system.

The present invention repositions the customary side mount thermostat 34 as shown in the FIG. 3 modification. Since FIG. 3 is straightforward, the low voltage DC motor application of FIG. 4 will be described. By repositioning the thermostat 34 from its customary side mount heater box position to a point directly in the exit plan 20 of the heater box and downstream of all heaters as shown in FIG. 4, the thermostat senses the temperature of the air, not internal of the heater box, but after it has been subjected to the high wattage heaters as it leaves the dryer. Preferably, the thermostat is disposed substantially entirely in the exit air stream at the exit plane so that it responds, and responds immediately, to exit air temperature only. This preferred location applies to either the FIG. 3 or FIG. 4 arrangements. In order to better and quickly sense the complete exit air temperature the thermostat is also disposed substantially centrally of the exit plane and across the entire exit plane as clearly shown in FIG. 2. While other orientations in the exit plane will suffice, this arrangement is preferred since it senses substantially exit air temperature only and a cross section of that exit air through all its layers. The exit plane location provides immediate and fast reaction to any overtemperature condition which can occur rapidly due to the high wattage heaters R3 and R4. In order for fast corrective action, the thermostat in the FIG. 4 arrangement is connected in series with at least the high wattage heaters. The thermostat 34 is shown in its open position but it will be apparent how it completes the circuits when it is closed to its adjacent terminal.

It is important that the positioning of the thermostat in the exit plane be adhered to. Since it is only very slightly connected to any mass, it senses substantially exit air temperature only and reacts very fast since it is not subject to any heat-up time lag due to the mass of the heater box as it rises in temperature. The usual single thermostat in the wall of the heater box is unsatisfactory whether in the FIG. 3 or FIG. 4 case because in a partial air blockage the temperature goes up downstream of the heaters and the wall thermostat does not sense it. With high wattage heaters and the plastic material used in the heater box it is important that it be sensed accurately and rapidly and corrective action be immediately taken which the exit plane location provides. It is sufficient to reposition or to put the thermostat directly in the exit plane in the case of the 110 volt arrangement of FIG. 3 and the more rapid and more accurate sensing and consequent correction is obtained. It should be apparent that the repositioned thermostat 34 in the FIG. 3 modification normally operates only in abnormalities such as lowered motor speed due to friction in the bearings or worn brushes or with hair or lint blocking some of the openings resulting in a temperature increase which can be very and damagingly fast in high wattage dryers.

Thus, repositioning the conventional side mount thermostat to locate this sensing thermostat in the exit plane well downstream of all the heater elements and substantially away from the heater box mass results in an accurate and rapid response and immediate corrective action which is necessary as the wattage of the hand-held hair dryers keeps increasing.

While there have been described preferred forms of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In a hairdryer of the type including a casing having an air inlet and an air exit defining an exit plane, a motor driven fan for propelling air between said air inlet and said air exit, a heater box in said casing, said heater box including an exit opening, plural wattage heating elements comprising high and low wattage heating elements in electrical circuit disposed in said heater box for heating air to selected temperature for discharge through the air exit of said casing and thermostat means in said airstream downstream of said heating elements for sensing the air temperature and opening the electrical circuit to at least some of said heating elements upon sensing an over temperature condition, the improvement comprising:

said thermostat means being positioned across the entire exit plane of said casing and disposed substantially in said exit plane of said casing and in electrical series circuit with at least some of said heating elements.

2. Apparatus as described in claim 1 wherein the thermostat is also disposed substantially centrally of the exit plane of said casing to intercept all layers of heated exit air.

3. In a hair dryer of the type described in claim 1, the improvement comprising:

said thermostat means being connected in electrical circuit with at least the high wattage heating elements.

* * * * *